US005769287A

United States Patent [19]

Kim

[11] Patent Number: 5,769,287

[45] Date of Patent: Jun. 23, 1998

[54] SHAPING CLIP FOR A SHIRT COLLAR

[76] Inventor: Randy Kim, 7912 Sea Pines Rd., Orland Park, Ill. 60462

[21] Appl. No.: 727,342

[22] Filed: Oct. 7, 1996

[51] Int. Cl.[6] ..... D06C 15/00

[52] U.S. Cl. ..... 223/83; 223/84; 24/900.1; 24/51

[58] Field of Search ..... 24/900.1, 51, 66.6, 24/705; 223/52.1, 81, 83, 84, 1

[56] References Cited

U.S. PATENT DOCUMENTS

| | | | |
|---|---|---|---|
| 314,794 | 3/1885 | Cables | 24/64 |
| 680,047 | 8/1901 | King | 24/64 |
| 938,749 | 11/1909 | Ferguson et al. | 24/64 |
| 1,019,324 | 3/1912 | Hepp | 24/64 |
| 1,120,122 | 12/1914 | Betts | 223/81 |
| 1,817,662 | 8/1931 | Allison | 24/900.1 |
| 1,903,746 | 3/1933 | Lutz | 24/64 |
| 2,492,239 | 12/1949 | Rowan | 24/900.1 |
| 2,846,127 | 8/1958 | Tomarin | 223/83 |
| 4,927,063 | 5/1990 | Fricano | 223/84 |

*Primary Examiner*—Bibhu Mohanty
*Attorney, Agent, or Firm*—Ernest Kettelson

[57] ABSTRACT

A shaping clip for a shirt collar to hold the shirt collar in a neat round position when not being worn, and to prevent the shirt collar from becoming wrinkled. The shaping clip comprises an outer relatively long V-shaped band of somewhat resilient but yet stiff material to be placed along the outside of the central front portion of the shirt collar, and an inner relatively shorter arcuate shaped band of the same stiffening material to be placed along the inner surface of the central front portion of the shirt collar. A clamping mechanism is provided to clamp the outer band and inner band together with the central front portion of the shirt collar sandwiched therebetween. The clamp mechanism includes a socket member with a receiving socket integrally formed on one of the bands, preferably the outer band, and an insert member integrally formed on the other for clamping reception in the receiving socket of the socket member.

9 Claims, 2 Drawing Sheets

SHAPING CLIP FOR A SHIRT COLLAR

BACKGROUND OF THE INVENTION

This invention relates to the field of devices to make shirt collars hold their shape. The invention in this case takes the form of a two part clip which clamps, shapes and holds the shirt collar which is sandwiched therebetween.

Prior Art

Prior art of which the inventor is aware comprises the disclosures in the following United States patents.

U.S. Pat. No. 3,088,117 discloses reinforcing panels for a shirt collar and cuffs.

U.S. Pat. No. 2,724,836 discloses a pair of elongated supporting panels for placing under the fold-over flap of a shirt collar.

U.S. Pat. No. 2,633,576 discloses a moisture proof protector for a shirt collar to protect against soiling. It is placed over the collar when in use.

U.S. Pat. No. 2,089,748 discloses a reinforcing panel to provide a reinforced shirt collar.

U.S. Pat. No. 1,764,212 discloses an elongated stiffening panel to be inserted into a sleeve or pocket around the neck portion of shirt collars which have such pockets or sleeves.

U.S. Pat. No. 1,555,218 discloses a necktie support which is mounted on the collar button of a shirt, having laterally extending fingers to extend outwardly under the fold-down flap of the collar to each side of the collar button, and having a sharp pin projecting upward and forward to pierce and hold the knot of a necktie.

U.S. Pat. No. 1,102,431 discloses a detachable shirt collar.

U.S. Pat. No. 962,665 discloses another kind of detachable shirt collar.

U.S. Pat. No. 912,958 discloses a collar button assembly which comprises a slightly curved strip having a collar button extending from its convex surface at midpoint. The curved strip is adapted to bear against the facing surface of the shirt band on which it is positioned with the collar button extending outwardly to seat in the button hole of the detachable collar.

U.S. Pat. No. 869,259 discloses a collar stiffener for shirts comprising an elongated strip that is placed under the fold-down flap of the shirt collar.

U.S. Pat. No. 643,793 discloses an elongated collar stiffening panel placed under the fold-down flap of the collar and secured to the shirt by a plurality of laterally spaced apart buttons.

U.S. Pat. No. 463,884 discloses a collar for flannel shirts having elongated stiffening pieces inserted under the flaps of the collar.

SUMMARY OF THE INVENTION

The invention in this case provides an improvement over stiffening and shaping devices for shirts previously known to the prior art.

The shaping device in accordance with the present invention comprises a two part clip to shape and hold the collar of a shirt neatly in its correct position while being offered for sale, or while in the drawer or on a shelf after having been laundered.

The two parts comprise an outer V-shaped band that is relatively long and an inner arcuate band that is relatively short which can be clamped together to sandwich the front central part of the shirt collar therebetween. The outer V-shaped band has a first relatively long leg which extends under the fold down flap of the shirt collar in one direction from the top shirt button over which the outer band is placed, and a second relatively long leg which extends under the fold-down flap of the shirt collar in the opposite direction from the top button.

The inner arcuate band is placed inside of the shirt collar and clamped together with the outer band by a clamping mechanism consisting of an insert member integrally formed along the upper edge of the inner arcuate band received and held in the socket of a socket member integrally formed along the upper edge of the outer band.

When clamped together, the inner and outer bands which are made of a resilient but nevertheless relatively stiff material hold the shirt collar in a neat rounded position while on display for sale, or in a drawer for eventual use.

The shaping clip in accordance with this invention can be easily separated from the shirt collar when the shirt is going to be worn. It can be re-used and easily snapped back in place when the shirt is not being worn to keep the collar shaped in the neat rounded position, and to prevent wrinkling of the collar.

DESCRIPTION OF PREFERRED EMBODIMENT

Figure 1:
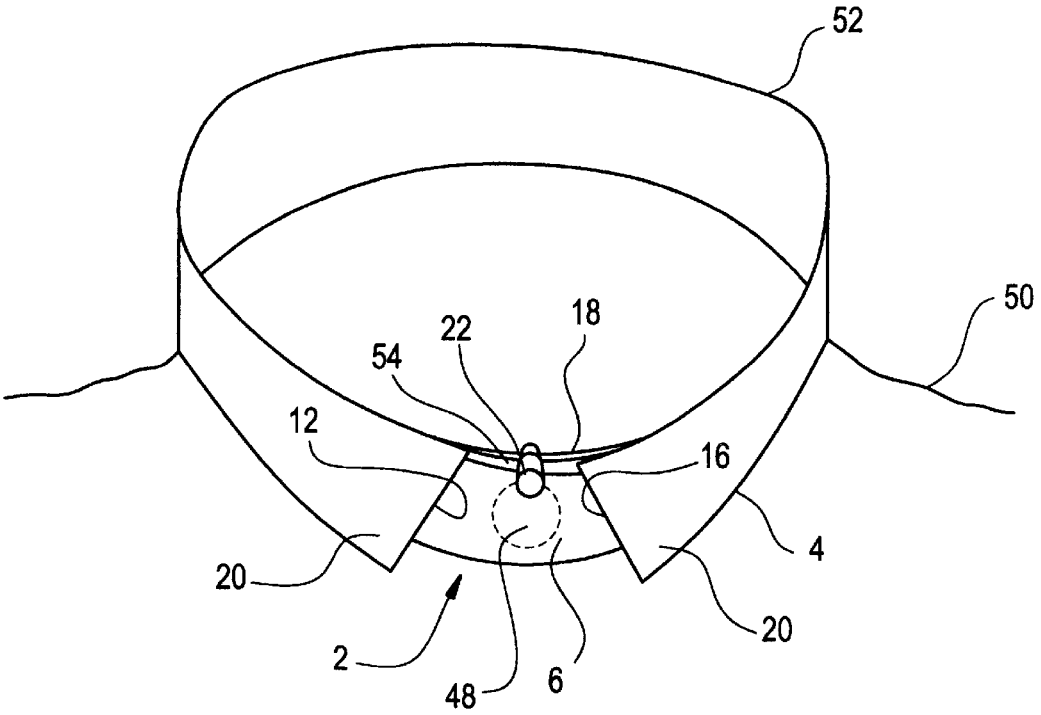
FIG. 1 is a perspective view of a shirt collar having a shaping clip in accordance with this invention in place thereon.
Figure 2:
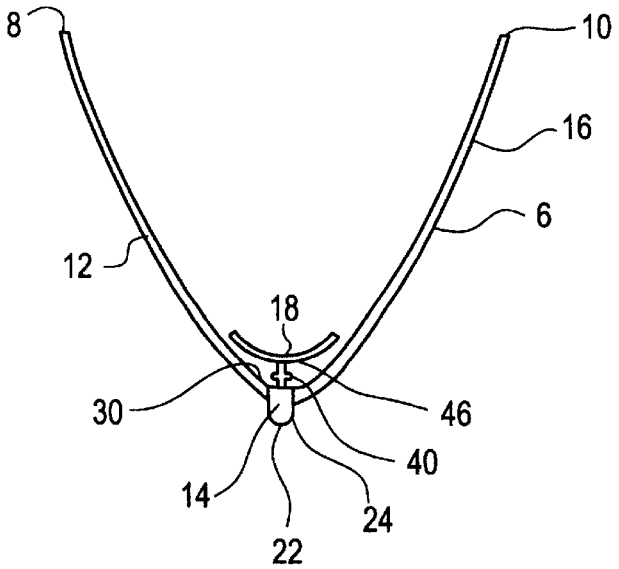
FIG. 2 is a top plan view of a shaping clip in accordance with this invention shown with the smaller inner band in position to be clamped together with the larger outer band.
Figure 3:
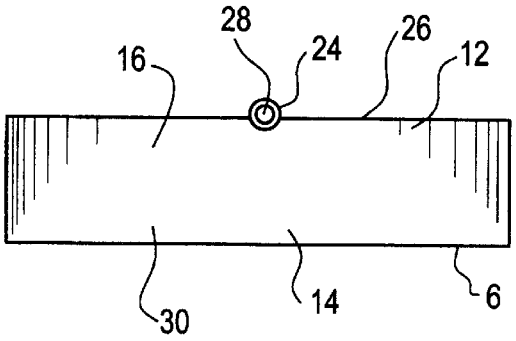
FIG. 3 is an elevation view of the larger outer band taken from the rear, enlarged to its approximate actual size.
Figure 4:
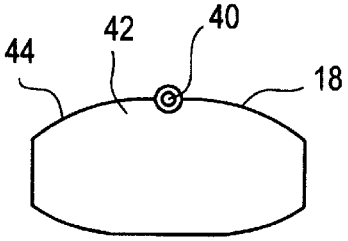
FIG. 4 is an elevation view of the smaller inner band taken from the front, enlarged to its approximate actual size.
Figure 5:
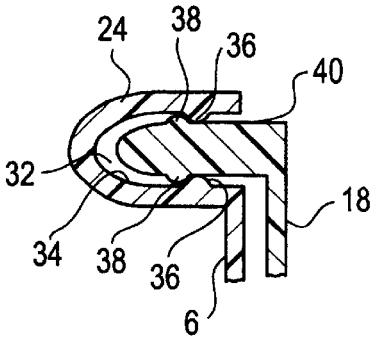
FIG. 5 is an enlarged section view of the socket member which is integrally formed along the upper edge of the outer band at its apex and of the insert member which is integrally formed along the upper edge of the inner band at its midpoint received in the socket.

A shaping clip 2 for a shirt collar 4 in accordance with this invention comprises a V-shaped band 6 of resilient but firm material such as an appropriate plastic material. The V-shaped band 6 has a relatively thin cross-section, and while resilient it has sufficient firmness or rigidity to hold its shape and the shape of a shirt collar on which it is used.

The V-shaped band 6 has a total linear length from its first end 8 to its second end 10 of about three inches, and includes a first leg 12 which extends about one and a half inches from the apex 14 of the band toward one diagonal direction and a second leg 16 which extends about one and a half inches in the opposite diagonal direction about one and a half inches from the apex 14.

The band 6 has a width or lateral dimension of about three fourths of an inch.

A second band 18 of the same material but shorter and arcuate in shape is provided as a clamp to sandwich the front central portion of a shirt collar 4 between the short arcuate second band 18 on the inside of the collar and the longer V-shaped band 6 on the outside of the collar and under the wings 20 of the shirt collar when they are folded down in place for normal use.

A clamp connecting mechanism 22 releasably holds the bands 6 and 18 of the shaping clip 2 together in clamping relationship. The clamp connecting mechanism includes a socket member 24 integrally formed on the V-shaped band 6 at its apex 14 and extending upward above its upper edge 26, having a socket opening 28 facing rearwardly in the direction toward the second short and arcuate band 18 when it is received in clamping relationship in the crotch 30 of the V-shaped band 6.

The socket member 24 has a socket 32 with an interior annular wall 34 having a compressive section or detent member 36 which can be compressed enough to allow an expanded portion 38 of an insert member 40 on the smaller arcuate band 18 to pass, after which the compressive section 36 returns to its original non-compressed position.

The insert member 40 is integrally formed at the center 42 of the smaller arcuate band 18 and above its upper edge 44, extending forwardly from the convex surface 46 thereof in the direction toward the longer V-shaped band 6 when the two are in position to be clamped together.

The shaping clip 2 for a shirt collar is used as follows to hold a shirt collar in the desired position, either for new shirts being offered for sale or for used shirts after having been laundered.

The top button 48 of the shirt 50 is buttoned and the annular collar fold 52 having the collar wings 20 at each opposite end is turned down to its normal position. The longer V-shaped band 6 is placed on the outside of the shirt collar with one leg 12 going under one of the collar wings 20 of the annular collar fold 52 extending in one direction from the top button 48 and the other leg 16 going under the other of the collar wings 20 of the collar fold 52 extending in the opposite direction from the top button 48. The apex 14 of the V-shaped band 6 is at such time over and to the outside of the top button 48 of the shirt 50.

The socket member 24 of the V-shaped band 6 extends above the upper edge 54 of the shirt collar 4 with its socket opening 28 facing rearwardly.

The second and shorter arcuate band 18 is then positioned on the inside of the shirt collar with its convex surface 46 facing toward the crotch 30 of the V-shaped band 6 in place on the outside of the shirt collar 4, and with its insert member 40 in alignment with the socket opening 28 of the socket member 24 of the V-shaped band 6.

The bands 6 and 18 are then pressed together with the insert member 40 of band 18 being received in the socket 32. The bands are pressed together with sufficient pressure to enable the expanded portion 38 of the insert member 40 to compress the compressive section 36 of the interior annular wall 34 of the socket 32 enough to pass, after which the compressive section 36 is released and returns to its non-compressed position thereby holding the insert member 40 securely within the socket 32 and thus holding the bands 6 and 18 securely in clamping relationship with the facing portions of the shirt collar 4 sandwiched therebetween.

The particular shape of the shorter arcuate band 18 and of the longer V-shaped band 6 as shown and described herein, hold the front central portion of a shirt collar in the proper and neat position when clamped together as described.

The shaping clip 2 in accordance with the present invention is easy to remove when the shirt is going to be used. All that is required is to exert pressure on the bands 6 and 18 in the separating direction to enable the insert member 40 to compress the compressive section 36 of the socket 32 enough to pass on the way out, the same in the reverse direction as when inserted to clamp the two bands together.

After being separated for the shirt to be worn, the shaping clip 2 in accordance with this invention can be saved for re-use as often as desired after the shirt has been washed, to keep an owner's shirts neatly shaped.

I claim:

1. A shaping device for a collar having an outer and an inner surface, an upper edge and a buttoned front center portion, comprising first shaping means for placement along said outer surface of said collar extending in each opposite direction from said buttoned front center portion of said collar for shaping thereof, second shaping means for placement along said inner surface of said collar extending arcuately in each opposite direction from said buttoned front center portion of said collar for shaping thereof, and clamping means to clamp said first and second shaping means together with said outer and inner surfaces of said collar sandwiched therebetween said clamping means including interconnecting members located above said upper edge of said collar when interconnected in place thereon, wherein said first shaping means includes a linearly elongated band of stiffening material having a central portion and an upper edge thereof, a first integrally formed leg extending in one diagonal direction from said central portion of said elongated band and a second integrally formed leg extending in an opposite diagonal direction from said central portion of said elongated band.

2. A shaping device for a collar as set forth in claim 1, wherein said second shaping means includes a relatively short arcuate band of stiffening material having a linear dimension less than that of said linearly elongated band, said relatively short arcuate band having a mid-portion and an upper edge thereof, a first lateral portion extending laterally in one direction from said mid-portion of said short arcuate band and a second lateral portion extending laterally in the opposite direction therefrom, said central portion of said elongated band and said mid-portion of said arcuate band being in substantial alignment with said buttoned front center portion of a said collar when clamped in place thereon.

3. A shaping device for a collar as set forth in claim 2, wherein said interconnecting members of said clamping means include a first clamping member for said linearly elongated band positioned along said upper edge of said central portion thereof, a second clamping member for said relatively short arcuate band positioned along said upper edge of said mid-portion thereof, said first and second clamping members being movable between a clamped position to clamp said linearly elongated band to said relatively short arcuate band and an unclamped position to release said bands from clamping relationship with each other.

4. A shaping device for a collar as set forth in claim 3, wherein one of said first and second clamping members comprises a socket member having a receiving socket therein, and the other of said clamping members comprises an insert member for reception into said receiving socket of said one of said first and second clamping members.

5. A shaping device for a collar as set forth in claim 4, wherein said first and second clamping members are integrally formed as part of the respective band on which each is located.

6. A shaping device for a collar as set forth in claim 4, wherein said socket member is integrally formed with said linearly elongated band and said insert member is integrally formed with said relatively short arcuate band.

7. A shaping device as set forth in claim 4, wherein said receiving socket includes an interior socket wall surrounding a socket passageway, detent means on said interior socket wall facing into the said passageway of said socket, said insert member includes cooperative detent means to engage said detent means of said interior socket wall when being inserted into said socket whereupon said insert member is releasably clamped to and held in said receiving socket.

8. A shaping device as set forth in claim 7, wherein said detent means on said interior socket wall of said receiving socket includes a compressible member projecting into said passageway of said socket.

9. A shaping device as set forth in claim 7, wherein said detent means of said insert member includes an elongated shank, and a compressible member projecting outwardly from said elongated shank.

* * * * *